US005257677A

United States Patent [19]

Stepp

[11] Patent Number: 5,257,677

[45] Date of Patent: Nov. 2, 1993

[54] CLIMBING DEVICE FOR COLUMNAR MEMBERS, SUCH AS TREES, POLES AND THE LIKE

[76] Inventor: James L. Stepp, P.O. Box 118, South Casco, Me. 04077

[21] Appl. No.: 980,766

[22] Filed: Nov. 24, 1992

[51] Int. Cl.[5] ..... A63B 27/00

[52] U.S. Cl. ..... 182/133; 182/187

[58] Field of Search ..... 182/187, 133, 228, 92; 248/231, 218.4

[56] References Cited

U.S. PATENT DOCUMENTS

| | | | |
|---|---|---|---|
| 3,460,649 | 8/1969 | Baker et al. . | |
| 3,955,645 | 5/1976 | Dye . | |
| 4,113,057 | 9/1978 | Bessinger | 182/187 |
| 4,168,765 | 9/1979 | Ferguson et al. . | |
| 4,230,203 | 10/1980 | Sweat et al. | 182/187 X |
| 4,316,526 | 2/1982 | Amacker | 182/187 X |
| 4,331,216 | 5/1982 | Amacker | 182/187 X |
| 4,337,844 | 7/1982 | Hice, Sr. | 182/187 |
| 4,411,335 | 10/1983 | Forrester | 182/187 X |
| 4,417,645 | 11/1983 | Untz | 182/187 X |
| 4,427,092 | 1/1984 | Tentler | 182/134 |
| 4,428,459 | 1/1984 | Peck | 182/187 |
| 4,488,620 | 12/1984 | Gibson | 182/187 X |
| 4,549,633 | 10/1985 | Merritt | 182/187 X |
| 4,552,246 | 11/1985 | Thomas | 182/187 X |
| 4,553,634 | 11/1985 | Roberts et al. | 182/187 X |
| 4,595,076 | 6/1986 | Gober . | |
| 4,595,079 | 6/1986 | Shope | 182/187 |
| 4,597,473 | 7/1986 | Peck | 182/187 |
| 4,600,081 | 7/1986 | Wade | 182/187 |
| 4,648,483 | 3/1987 | Skyba | 182/187 |
| 4,726,447 | 2/1988 | Gibson et al. | 182/187 X |
| 4,730,700 | 3/1988 | Miller et al. | 182/187 |
| 4,802,552 | 2/1989 | Williams | 182/187 |
| 4,809,815 | 3/1989 | Wallace | 182/187 X |
| 4,830,143 | 5/1989 | Fisher | 182/187 X |
| 4,890,694 | 1/1990 | Williams | 182/187 |
| 4,909,353 | 3/1990 | Govin et al. | 182/187 |
| 4,921,069 | 5/1990 | Boyles | 182/135 |
| 4,953,662 | 9/1990 | Porter | 182/187 X |
| 4,969,538 | 11/1990 | Amacker | 182/187 |
| 4,987,972 | 1/1991 | Helms | 182/187 |
| 4,995,475 | 2/1991 | Berkbuegler | 182/187 |
| 5,009,285 | 4/1991 | Ramsey | 182/187 |
| 5,052,516 | 10/1991 | Jamieson | 182/135 |
| 5,078,232 | 1/1992 | Hancosky | 182/187 |
| 5,090,504 | 2/1992 | Amacker | 182/187 |
| 5,097,925 | 3/1992 | Walker, Jr. | 182/187 X |
| 5,101,934 | 4/1992 | Zumbro | 182/187 |
| 5,103,935 | 4/1992 | Amacker | 182/187 |
| 5,105,910 | 4/1992 | Engstrom | 182/187 |
| 5,156,096 | 10/1992 | Lamprey | 182/187 X |
| 5,167,298 | 12/1992 | Porter | 182/187 |

*Primary Examiner*—Ramon O. Ramirez
*Attorney, Agent, or Firm*—Ralph W. Selitto, Jr.

[57] ABSTRACT

A portable appliance adapted for temporary attachment to a columnar member, such as a tree, pole, or the like, includes a frame which is attached to the columnar member by a tensile member such that the frame is pivotable between an unlocked position, in which the frame is loosely attached to the columnar member, and a locked position, in which the frame is securely attached to the columnar member. Because the distance between the attaching means and the columnar member increases as the frame pivots from its unlocked position to its locked position, the tensile member is tensioned in response to such pivotal movement of the frame. In order to inhibit the inadvertent detachment of the appliance from the columnar member when the frame is in its locked position, the attaching means is located between an upper end and a lower end of the frame and adjacent to an outer edge thereof. To facilitate transportation and storage, the frame can be collapsible and/or nestable.

20 Claims, 3 Drawing Sheets

CLIMBING DEVICE FOR COLUMNAR MEMBERS, SUCH AS TREES, POLES AND THE LIKE

FIELD OF THE INVENTION

The present invention relates to a portable appliance adapted for temporary attachment to a columnar member, such as a tree, pole or the like, and, more particularly, to such an appliance which can take the form of a climbing aid, a stand or a seat.

BACKGROUND OF THE INVENTION

In the past, a variety of climbing devices and support structures have been developed for use by hunters, naturalists and others having a need to ascend a columnar member, such as a tree or a pole, and then remain there for a given period of time. Initially, such devices and structures were designed for generally permanent attachment to the columnar member. These early devices and structures were not only time consuming to construct, but were also difficult to remove due to their generally permanent attachment to the columnar member.

The subsequent development of portable climbing devices and support structures, such as those disclosed in U.S. Pat. Nos. 4,230,203; 4,553,634; 4,595,079; 4,830,143; 4,909,353; 4,921,069; 5,052,516 and 5,078,232, was in response to the need to ascend a plurality of columnar members located at different locations. A characteristic common to all of these portable climbing devices and support structures is their removable attachment to the columnar members.

While many different types of mechanisms have been proposed for removably attaching the above-described portable climbing devices and support structures, one type of attachment mechanism involves loosely strapping the climbing device or support structure to a tree or pole using a chain and then employing a lever-action mechanism or a cam-action mechanism to tighten the chain (see, for instance, U.S. Pat. Nos. 4,411,335; 4,600,081; 4,730,700 and 5,009,285). While such lever-action and cam-action mechanisms may function effectively to secure their associated climbing device and/or support structure to a columnar member, they are susceptible to inadvertent disengagement, thereby presenting a potential hazard to a user.

SUMMARY OF THE INVENTION

The present invention relates to a new and improved portable appliance adapted for temporary attachment to a columnar member, such as a tree, pole, or the like, by a tensile member extending around the columnar member. More particularly, the appliance includes a frame and attaching means for attaching the frame to the tensile member such that the frame is pivotable between a first (i.e., unlocked) position, in which the frame is loosely attached to the columnar member, and a second (i.e., locked) position, in which the frame is securely attached to the columnar member. Because the distance between the attaching means and the columnar member increases as the frame pivots from its unlocked position to its locked position, the tensile member is tensioned in response to such pivotal movement of the frame. In accordance with one unique feature of the present invention, the attaching means is located by between an upper end and a lower end of the frame and adjacent to an outer edge thereof, thereby inhibiting the inadvertent detachment of the appliance from the columnar member when the frame is in its locked position.

The frame includes a pair of beams, each beam having a leg, an arm and an elbow connecting the leg to the arm. A removable crossbar, which functions as the attaching means, extends between the two beams. The legs of the beams can be pivotally connected to each other to permit the frame to be collapsed once the crossbar has been removed, thereby facilitating transportation and storage of the frame. Transportation and storage can also be facilitated by providing the frame with a triangulated wedge shape, whereby the appliance is nestable with other identical appliances.

When the appliance is used as a climbing aid, the arms of the beams would be sized and shaped so as to function as footrests when the frame is in its locked position. In addition, the crossbar would be sized and shaped so as to function as a handhold when the frame is in its locked position.

When the appliance is used as a stand or a seat, a platform would be attached to the upper end of the frame. The platform would have a size and shape selected so as to support a user in a standing or sitting position.

BRIEF DESCRIPTION OF THE DRAWINGS

For a better understanding of the present invention, reference is made to the following detailed description of two exemplary embodiments of the invention, considered in conjunction with the accompanying drawings, in which.

DESCRIPTION OF THE EXEMPLARY EMBODIMENTS

Although the present invention is adapted for use on many different types of columnar members, it is especially suitable for use on trees. Accordingly, the present invention will be described below as a climbing aid and stand for trees.

Figure 1:
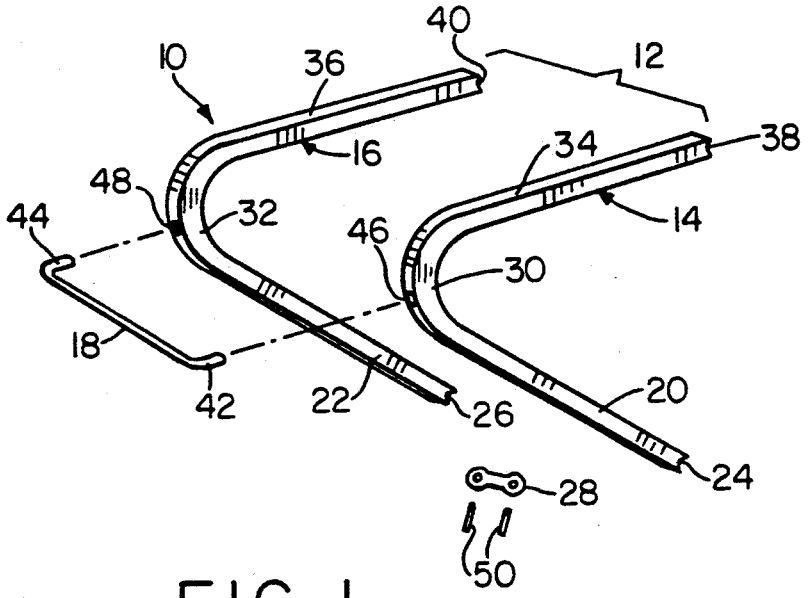
FIG. 1 is an exploded perspective view of a tree climbing aid constructed in accordance with one exemplary embodiment of the present invention.

Referring to FIG. 1, a tree bracket 10 includes a frame 12 made from a pair of main beams 14, 16. A removable crossbar 18 extends between the main beams 14, 16 for purposes to be described hereinafter.

The main beams 14, 16 have legs 20, 22, respectively, which terminate in sharpened ends 24, 26, respectively.

The ends 24, 26 of the legs 20, 22 are connected together by a link 28, which permits the main beams 14, 16 to pivot relative to each other, whereby the frame 12 can be collapsed by removing the crossbar 18 and folding the main beams 14, 16 against each other. When the frame 12 is collapsed, it is more compact and therefore easier to transport and store.

From their ends 24, 26, the legs 20, 22 diverge as they merge into elbows 30, 32, respectively, which also merge into arms 34, 36, respectively, having sharpened ends 38, 40, respectively. The angle of divergence of the legs 20, 22 is determined by the length of the crossbar 18, which has plug-shaped ends 42, 44 sized and shaped so as to be removably received within sockets 46, 48, respectively, provided in the elbows 30, 32, respectively, of the main beams 14, 16 at locations proximate to the legs 20, 22.

From their ends 38, 40, which are spaced apart, the arms 34, 36 diverge as they merge into the elbows 30, 32. The angle of divergence of the arms 34, 36 and the spacing between their ends 38, 40 are also determined by the length of the crossbar 18.

If the crossbar 18 is removed and replaced with a longer or shorter crossbar, the link 28 permits the appropriate adjustment to be made in the relative positions of the main beams 14, 16. For instance, if a shorter crossbar is utilized, the main beams 14, 16 would be closer to each other, thereby decreasing the angle of divergence of the legs 20, 22 and the arms 34, 36. If a longer crossbar is utilized, the main beams 14, 16 would be farther apart, thereby increasing the angle of divergence of the legs 20, 22 and the arms 34, 36. Such adjustments are permitted by attaching the link 28 to the main beams 14, 16 using fasteners 50 adapted to allow pivotal movement of both of the main beams 14, 16 relative to the link 28. Of course, it is conceivable that only one of the main beams 14, 16 would be pivotable relative to the link 28. It is also conceivable that neither of the main beams 14, 16 would be pivotable relative to the link 28, in which case the main beams 14, 16 could not be folded against each other and, as a result, the frame 12 would not be collapsible.

Figure 2:
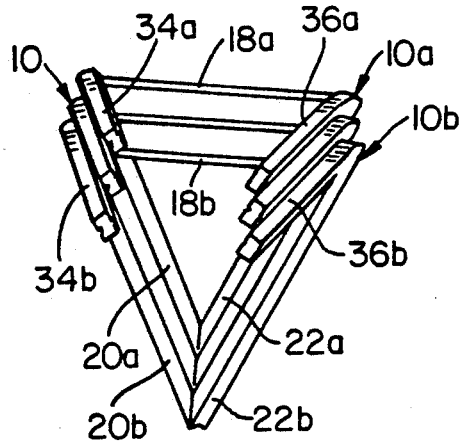
FIG. 2 is a rear view of the climbing aid of FIG. 1 shown nested with two other climbing aids.

While the crossbar 18 is removably attached to the main beams 14, 16, it could be permanently attached to the main beams 14, 16, whereby the frame 12 would have an integrated construction. Regardless of whether the crossbar 18 is removably or permanently attached to the main beams 14, 16, the frame 12 has a triangulated wedge shape which, in cooperation with the opening formed by the spacing between the arms 34, 36, permits the bracket 10 to be nestable with other similar brackets (see, for instance, FIG. 2 in which the bracket 10 is shown nested within similar brackets 10*a* and 10*b* having crossbars 18*a* and 18*b*, respectively; legs 20*a*, 22*a* and 20*b*, 22*b*, respectively; and arms 34*a*, 36*a* and 34*b*, 36*b*, respectively). When nested, the brackets 10, 10*a*, 10*b* form a compact array which facilitates their transportation and storage as a group.

Figure 3:
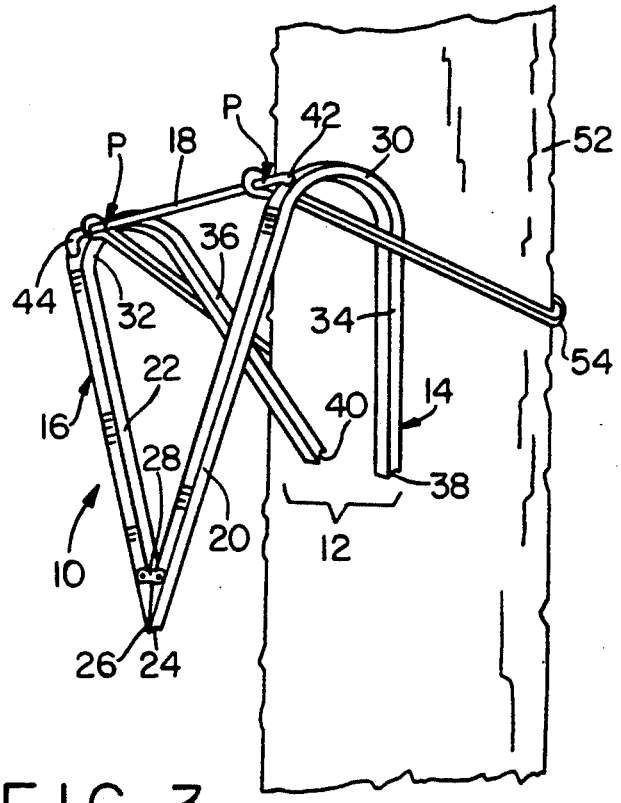
FIG. 3 is a perspective view showing the climbing aid of FIG. 1 attached to a tree in a raised or unlocked position.
Figure 4:
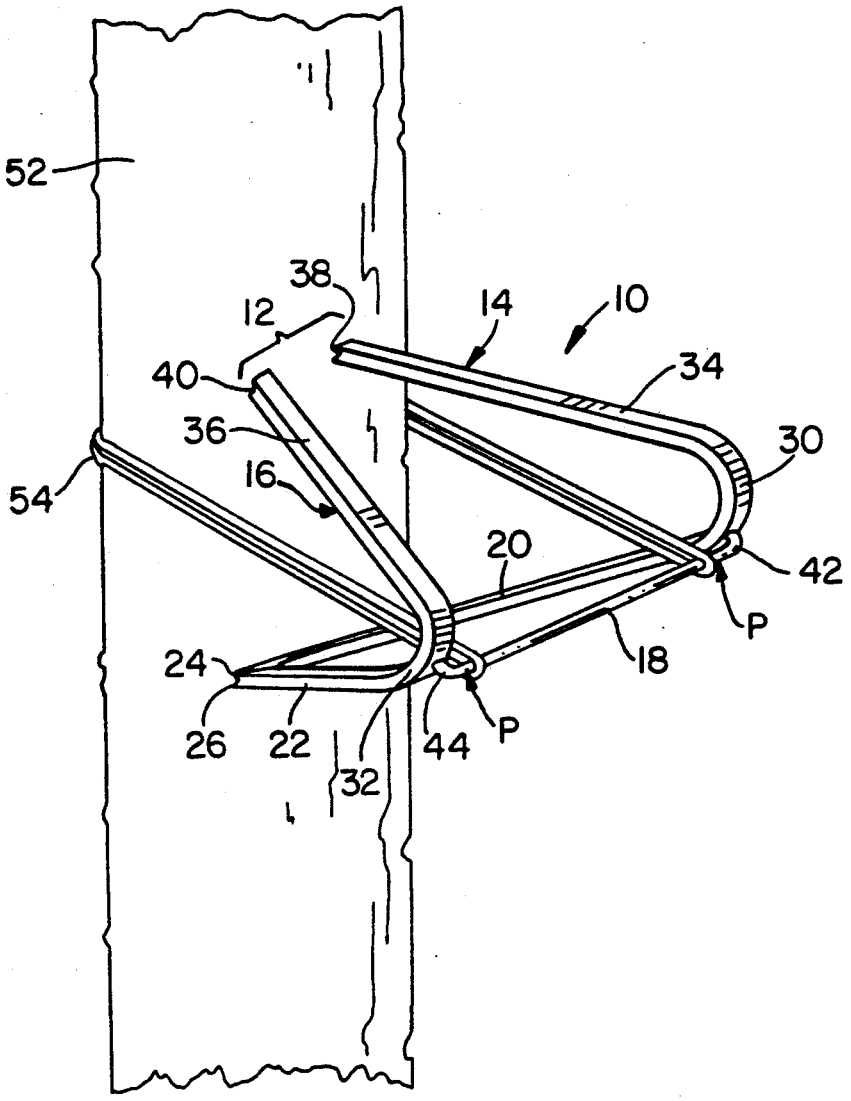
FIG. 4 is a perspective view showing the climbing aid of FIG. 1 attached to a tree in a lowered or locked position.

Referring to FIGS. 3 and 4, the bracket 10 is installed on a tree 52 using a steel cable 54 or any other suitable tensile member, such as a rope or a strap, which is capable of being tensioned. More particularly, the steel cable 54 would be looped around the tree 52 and then attached to the crossbar 18 at points P adjacent the main beams 14, 16. The crossbar 18 therefore functions as an attachment mechanism for the bracket 10, in addition to other functions which will be described hereinafter.

When initially installed, the bracket 10 is in a raised or unlocked position (see FIG. 3) in which the arms 34, 36 are maintained in a substantially vertical or inclined orientation relative to the tree 52 and the ends 24, 26 of the legs 20, 22 are suspended away from the tree 52. In this position, the points P (i.e., the points where the steel cable 54 is attached to the crossbar 18) are proximate to the tree 52.

By pulling down on the legs 20, 22, the bracket 10 is swung downwardly into a lowered or locked position (see FIG. 4) in which the arms 34, 36 are maintained in a substantially horizontal orientation relative to the tree 52 and the ends 24, 26 of the legs 20, 22 engage the tree 52. As the bracket 10 swings into its lowered or locked position, the points P move further from the tree 52, thereby increasing the tension on the steel cable 54 so as to securely attach the bracket 10 to the tree 52. The attachment of the bracket 10 to the tree 52 is also enhanced by making the ends 24, 26 of the legs 20, 22 and the ends 38, 40 of the arms 34, 36 sharp enough to dig into the tree 52.

In use, a user standing on the ground would install the brackets 10, 10*a*, 10*b* on a tree at intervals of approximately two feet. The user would then utilize the brackets 10, 10*a*, 10*b* to ascend the tree, the crossbars 18, 18*a*, 18*b* being utilized as handholds and the arms 34, 36; 34*a*, 36*a*; 34*b*, 36*b* as footrests. If additional brackets are required, they would be installed, at, for instance, two foot intervals, by the user as he or she is standing on the previously installed brackets and leaning back against a safety strap which would be fastened to the tree. After all of the brackets have been installed to the height desired, they would form a ladder which can be ascended and descended with the security of having both hands and feet in indirect, but firm, contact with the tree.

The points P (i.e., the points where the steel cable 54 is attached to the bracket 10) are located to provide an additional safety feature. Referring to FIG. 4, it can be seen that the points P lie below the arms 34, 36 and are adjacent an outer edge of the bracket 10 (i.e., the edge defined by the elbows 30, 32 when the bracket 10 is in its lowered or locked position illustrated in FIG. 4). Such positioning of the points P inhibits the inadvertent disengagement of the bracket 10 from the tree 52 when a force, such as that exerted by the feet of a user who is standing on the bracket 10, is applied to an inner edge of the bracket 10 (i.e., the edge defined by the ends 38, 40 of the arms 34, 36 when the bracket 10 is in its lowered or locked position illustrated in FIG. 4). More particularly, when such a force is applied to the bracket 10, the tendency would be for the arms 34, 36 to pivot downwardly about the points P. Any such pivotal movement of the bracket 10 is, however, inhibited because it would force the ends 38, 40 of the arms 34, 36 deeper into the tree 52, thereby creating increased resistance to the movement of the bracket 10. If the points P did not lie below the arms 34, 36, a force applied to the inner edge of the bracket 10 could cause the inadvertent disengagement of the arms 34, 36 as a result of their downward pivoting movement away from the tree.

Positioning the points P adjacent the outer edge of the bracket 10 is also advantageous because a user standing on the bracket 10 will always be positioned between the points P and the tree 52 and, as a result, will not be able to cause the arms 34, 36 to pivot upwardly away from the tree 52 by applying a force to the bracket 10 outboard from the points P. While any such pivotal movement of the arms 34, 36 might not result in the complete detachment of the bracket 10, it would, at a minimum, impair the stability of the bracket 10 and, hence, still present a potential hazard to the user.

The bracket 10 can be detached from the tree 52 and transported to another tree by reversing the foregoing attachment procedure. In other words, the bracket 10 would first be pivoted from its lowered or locked position (see FIG. 4) to its raised or unlocked position (see FIG. 3), whereby the tension on the steel cable 54 is reduced. With the tension on the steel cable 54 reduced, the steel cable 54 can be disengaged from the crossbar 18 with relative ease, thereby freeing the bracket 10 from the tree 52.

Figure 5:
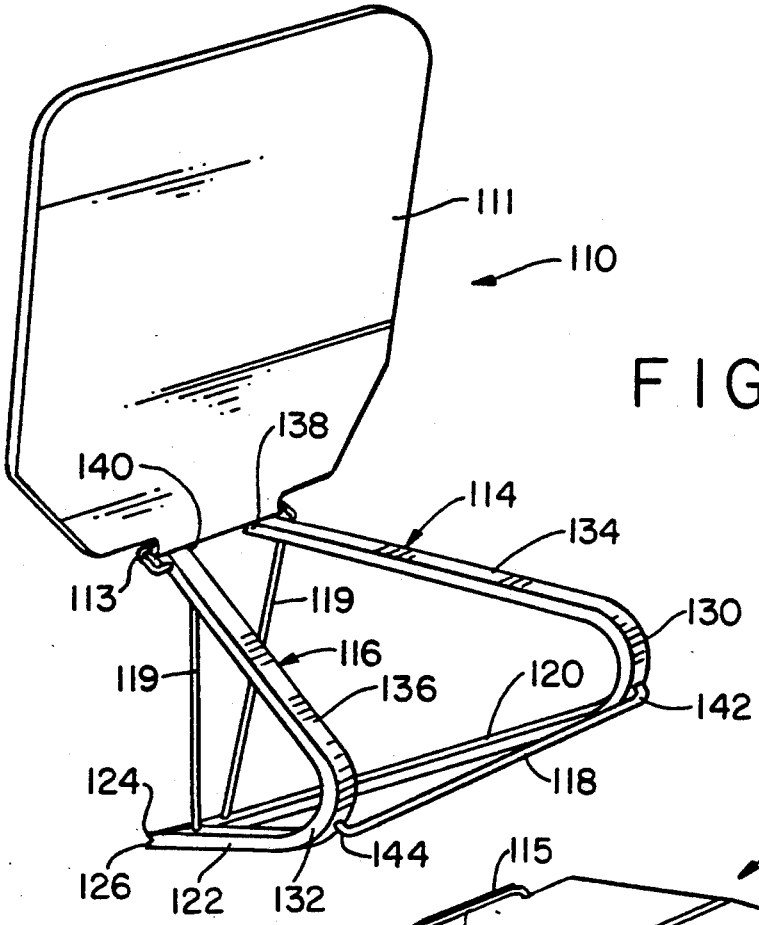
FIG. 5 is a front perspective view of a tree stand constructed in accordance with another exemplary embodiment of the present invention, the stand being shown with its platform in a raised or non-operable position.
Figure 6:
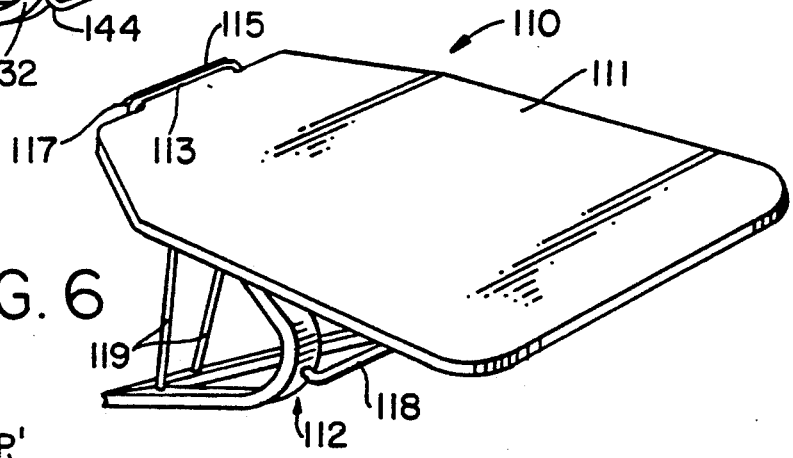
FIG. 6 is a front perspective view of the tree stand of FIG. 5, the stand being shown with its platform in a lowered or operable position.
Figure 7:
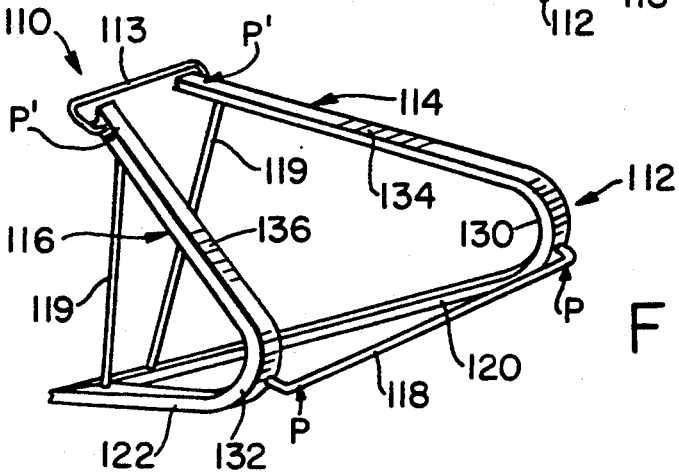
FIG. 7 is a front perspective view of the tree stand of FIGS. 5 and 6, the stand being shown with its platform removed.

While the embodiment of FIGS. 1–4 is especially adapted to function as a climbing aid, alternate embodiments of the present invention can function as a stand and/or a seat. One such alternate embodiment is illustrated in FIGS. 5–7. To facilitate consideration and discussion, elements illustrated in FIGS. 5–7 which correspond to the elements described above with respect to FIGS. 1–4 have been designated by corresponding reference numerals increased by one hundred. Elements illustrated in FIGS. 5–7 which have no counterparts in FIGS. 1–4 are designated by odd reference numerals. Unless otherwise stated, the embodiment of FIGS. 5–7 operates in the same manner as the embodiment of FIGS. 1–4.

Referring to FIGS. 5–7, a tree stand 110 includes a platform 111 and a frame 112 made from a pair of main beams 114, 116. A removable crossbar 118 extends between the main beams 114, 116.

The main beams 114, 116 have legs 120, 122, respectively, which terminate in sharpened ends 124, 126, respectively. The ends 124, 126 of the legs 120, 122 are connected together by a link (not shown), which permits the main beams 114, 116 to pivot relative to each other, whereby the frame 112 can be collapsed by removing the crossbar 118 and folding the main beams 114, 116 against each other. When the frame 112 is collapsed, it is more compact and therefore easier to transport and store.

From their ends 124, 126, the legs 120, 122 diverge as they merge into elbows 130, 132, respectively, which also merge into arms 134, 136, respectively, having sharpened ends 138, 140, respectively. The angle of divergence of the legs 120, 122 is determined by the length of the crossbar 118, which has plug-shaped ends 142, 144 sized and shaped so as to be removably received within sockets (not shown) provided in the elbows 130, 132 of the main beams 114, 116 at locations proximate to the legs 120, 122.

From their ends 138, 140, which are spaced apart, the arms 134, 136 diverge as they merge into the elbows 130, 132. The angle of divergence of the arms 134, 136 and the spacing between their ends 138, 140 are also determined by the length of the crossbar 118.

The platform 111 is pivotally mounted on the frame 112 by a clamp 113 which is affixed to the arms 134, 136 adjacent to their ends 138, 140 and which is received in a groove 115 formed in a tongue 117 of the platform 111. The clamp 113 permits the platform 111 to pivot between a raised or non-operable position (see FIG. 5), in which the platform 111 is in a substantially vertical orientation, and a lowered position (see FIG. 6), in which the platform 111 is supported in a substantially horizontal orientation by the arms 134, 136 of the frame 112.

Because the platform 111 is preferably large enough to accommodate a user in a standing or sitting position, the frame 112 would normally be larger than the frame 12 of the bracket 10. In order to improve the stability and rigidity of the frame 112, bracing struts 119 extend between the legs 120, 122 and the arms 134, 136 of the frame 112. The struts 119 are, however, optional; and, therefore, they could be omitted if the frame 112 has sufficient stability and rigidity without them.

In use, the stand 110 would be attached to a tree in basically the same manner as the bracket 10. However, as a further safety feature to prevent the inadvertent disengagement of the stand 110 from the tree, a steel cable used to attach the stand 110 to the tree could be passed completely around the tree and then anchored to the frame 112 at points P' located adjacent to an inner edge of the frame 112, as well as at points P located adjacent to an outer edge of the frame 112.

As a user ascends the tree to the stand 110, the platform 111 would be maintained in its raised position (see FIG. 5) so that the user can mount the frame 112 by standing on the arms 134, 136. After mounting the frame 112, the user would pivot the platform 111 to its lowered position (see FIG. 6) and then sit or stand on it.

It will be understood that the embodiments described herein are merely exemplary and that a person skilled in the art may make many modifications and variations without departing from the spirit and scope of the invention. All such variations and modifications are intended to be included within the scope of the invention as defined in the appended claims.

I claim:

1. A portable appliance for temporary attachment to a columnar member, such as trees and poles; by a tensile member extending around the columnar member, said appliance comprising a frame having an upper end, a lower end, an inner edge and an outer edge; and attaching means for attaching said frame to said tensile member such that said frame is pivotable between a first position, in which said frame is loosely attached to the columnar member and in which said attaching means is spaced from the columnar member a first distance, and a second position, in which said frame is securely attached to the columnar member and in which said attaching means is spaced from the columnar member a second distance which is greater than said first distance, wherein whereby said tensile member is tensioned in response to the pivotal movement of said frame from said first position to said second position, said attaching means being located between said upper and lower ends of said frame and adjacent to said outer edge thereof, thereby inhibiting the inadvertent detachment of said appliance from the columnar member when said frame is in said second position.

2. An appliance according to claim 1, wherein said frame includes a pair of beams, each beam having a leg, an arm and an elbow connecting said leg to said arm.

3. An appliance according to claim 2, wherein said leg of one of said beams is connected to said leg of the other of said beams.

4. An appliance according to claim 3, wherein said leg of said one beam has first gripping means for gripping the columnar member when said frame is in said second position and wherein said leg of said other beam has second gripping means for gripping the columnar member when said frame is in said second position.

5. An appliance according to claim 4, wherein said first gripping means is located at an end of said leg of said one beam and wherein said second gripping means is located at an end of said leg of said other beam.

6. An appliance according to claim 5, wherein said legs of said beams are connected together at said ends thereof.

7. An appliance according to claim 6, wherein said elbow and said arm of said one beam are spaced from said elbow and said arm, respectively, of said other beam.

8. An appliance according to claim 7, wherein said legs of said beams are pivotally connected at said ends thereof such that said beams can be folded against each other, whereby said frame is collapsible.

9. An appliance according to claim 7, wherein an end of said arm of said one beam has third gripping means for gripping the columnar member when said frame is in said second position and wherein an end of said arm of said other beam has fourth gripping means for gripping the columnar member when said frame is in said second position.

10. An appliance according to claim 9, wherein said frame has a triangulated wedge shape, whereby said appliance is nestable within another appliance identical thereto.

11. An appliance according to claim 9, wherein said arms of said beams form said upper end of said frame when said frame is said second position and wherein said ends of said legs of said beams form said lower end of said frame when said frame is in said second position.

12. An appliance according to claim 11, wherein said attaching means includes a crossbar extending between said one beam and said other beam, said crossbar being attached to said elbow of said one beam at a location proximate to said leg of said one beam and being attached to said elbow of said other beam at a location proximate to said leg of said other beam.

13. An appliance according to claim 12, wherein said crossbeam forms said outer edge of said frame when said frame is in said second position and wherein said first, second, third and fourth gripping means form said inner edge of said frame when said frame is in said second position.

14. An appliance according to claim 13, wherein said arms of said beams diverge as they extend from said ends thereof toward said elbows and wherein said legs of said beams diverge as they extend from said ends thereof toward said elbows.

15. An appliance according to claim 14, wherein said frame has a triangulated wedge shape, whereby said appliance is nestable within another appliance identical thereto.

16. An appliance according to claim 15, wherein said crossbar is removably attached to said beams.

17. An appliance according to claim 15, wherein said arms of said beams are sized and shaped so at to function as footrests when said frame is in said second position and wherein said crossbar is sized and shaped so as to function as a handhold when said frame is in said second position, whereby said appliance functions as a climbing aid when it is in said second position.

18. An appliance according to claim 16, further comprising a platform attached to said upper end of said frame, said platform being sized and shaped so as to support a user in a standing or sitting position, whereby said appliance functions as a stand or a seat.

19. An appliance according to claim 18, wherein said platform is removably attached to said frame.

20. An appliance according to claim 18, wherein said platform is pivotable about a pivot axis located adjacent to said ends of said arms of said beams such that said platform is pivotable between a raised position, in which said platform extends upwardly from said frame adjacent to said inner edge thereof, and a lowered position, in which said platform extends across said frame from said inner edge thereof to said outer edge thereof.

* * * * *

UNITED STATES PATENT AND TRADEMARK OFFICE

CERTIFICATE OF CORRECTION

PATENT NO. : 5,257,677

DATED : November 2, 1993

INVENTOR(S) : James L. Stepp

It is certified that error appears in the above-identified patent and that said Letters Patent is hereby corrected as shown below:

Column 6, line 47, delete "whereby".

Signed and Sealed this

Twenty-eighth Day of June, 1994

Bruce Lehman

*Attest:*

BRUCE LEHMAN

*Attesting Officer*

*Commissioner of Patents and Trademarks*